US010427756B2

(12) United States Patent
De Waal et al.

(10) Patent No.: US 10,427,756 B2
(45) Date of Patent: Oct. 1, 2019

(54) SHADING DEVICE OF A VEHICLE

(71) Applicant: WEBASTO SE, Stockdorf (DE)

(72) Inventors: Martin De Waal, Stockdorf (NL); Remco Koning, Stockdorf (NL); Patrick De Reus, Stockdorf (NL)

(73) Assignee: WEBASTO SE, Stockdorf (DE)

( * ) Notice: Subject to any disclaimer, the term of this patent is extended or adjusted under 35 U.S.C. 154(b) by 0 days.

(21) Appl. No.: 15/757,143

(22) PCT Filed: Oct. 13, 2015

(86) PCT No.: PCT/EP2015/073704
§ 371 (c)(1),
(2) Date: Mar. 2, 2018

(87) PCT Pub. No.: WO2017/063679
PCT Pub. Date: Apr. 20, 2017

(65) Prior Publication Data

US 2018/0257745 A1 Sep. 13, 2018

(51) Int. Cl.
*B63B 17/02* (2006.01)
*E04F 10/06* (2006.01)

(52) U.S. Cl.
CPC ..... *B63B 17/02* (2013.01); *E04F 10/0603* (2013.01); *E04F 10/0655* (2013.01); *B63B 2017/026* (2013.01)

(58) Field of Classification Search
CPC .... B63B 17/00; B63B 17/02; B63B 2017/026
(Continued)

(56) References Cited

U.S. PATENT DOCUMENTS 4,641,600 A * 2/1987 Halvorsen ..... B63B 17/02 114/361
2002/0053313 A1* 5/2002 Murphy ..... B63B 17/02 114/361

(Continued)

FOREIGN PATENT DOCUMENTS

DE 3146169 A1 5/1983
DE 8802849.6 U1 5/1988

(Continued)

OTHER PUBLICATIONS

International Search Report for PCT/EP2015/073704 dated Jul. 22, 2016 and English translation submitted herewith (5 Pages).

(Continued)

*Primary Examiner* — Lars A Olson
(74) *Attorney, Agent, or Firm* — Fitch, Even, Tabin & Flannery, LLP

(57) ABSTRACT

A shading device of a water vehicle, having a roller blind web, a winding unit, onto which the roller blind web can be wound or unwound and which, in relation to a longitudinal center plane of the roller blind web, is borne on both sides so as to be rotatable, and comprising, in relation to the longitudinal center plane of the roller blind web on each of its two sides, a telescopic tube arrangement having a bearing tube that is fixed relative to the vehicle and having at least one first pull-out tube and one second pull-out tube, which are displaceable between a slid-in position, the roller blind web having been wound up onto the winding unit when being in said position, and a pulled-out position, the roller blind web having been unwound from the winding unit when being in said position.

22 Claims, 11 Drawing Sheets

(58) Field of Classification Search
USPC ..... 114/361
See application file for complete search history.

(56) References Cited

U.S. PATENT DOCUMENTS

| | | | | |
|---|---|---|---|---|
| 2009/0031942 | A1 | 2/2009 | Russikoff | |
| 2011/0290170 | A1 | 12/2011 | Russikoff | |
| 2013/0206050 | A1* | 8/2013 | Russikoff | B63B 17/02 114/361 |
| 2015/0122169 | A1* | 5/2015 | Russikoff | B63B 17/02 114/361 |

FOREIGN PATENT DOCUMENTS

| | | | |
|---|---|---|---|
| EP | 1754659 | A2 | 2/2007 |
| EP | 1967401 | A2 | 9/2008 |
| NL | 1036724 | C | 9/2010 |

OTHER PUBLICATIONS

Written Opinion of the International Searching Authority (6 Pages). International Preliminary Report on Patentability issued against International Application No. PCT/EP2015/073704 dated Apr. 17, 2018.

* cited by examiner

SHADING DEVICE OF A VEHICLE

CROSS-REFERENCE TO RELATED APPLICATIONS

This application is a U.S. national phase application filed under 35 U.S.C. § 371 of International Application No. PCT/EP2015/073704, filed Oct. 13, 2015, designating the United States, which is hereby incorporated herein by reference in its entirety for all purposes.

FIELD

The invention relates to a shading device of a vehicle, in particular of a water vehicle.

Such a shading device is known from practice and may in particular be employed in a boat or in a yacht as a sun shade or as a sun protection installation, which can be realized like an awning.

BACKGROUND

It is the object of the invention to create a shading device which has a simple design and which is safe and easy to use.

According to one aspect, this object is attained by a shading device of a vehicle, in particular of a water vehicle, comprising a roller blind web, a winding unit, onto which the roller blind web can be wound up or from which the roller blind web can be unwound and which, in relation to a longitudinal center plane of the roller blind web, is borne on both sides so as to be rotatable, and comprising, in relation to the longitudinal center plane of the roller blind web on each of its two sides, a telescopic tube arrangement having a bearing tube that is fixed relative to the vehicle and having at least one first pull-out tube and one second pull-out tube, which are displaceable between a slid-in position, the roller blind web having been wound up onto the winding unit when being in said position, and a pulled-out position, the roller blind web having been unwound from the winding unit when being in said position, wherein at least one of the telescopic tube arrangements is provided with a drive unit, which directly drives the first pull-out tube, a rope arrangement converting a relative movement of the first pull-out tube vis-à-vis the bearing tube into a relative movement of the second pull-out tube vis-à-vis the first pull-out tube.

Hence, the essence of the invention is that at least one of the telescopic tube arrangements comprises a drive unit, which only takes effect on the first pull-out tube. The second pull-out tube is displaced vis-à-vis the first pull-out tube in a positively controlled fashion with the aid of the rope-operated arrangement, which converts a relative movement of the first pull-out tube vis-à-vis the bearing tube into a relative movement of the second pull-out tube vis-à-vis the first pull-out tube. The roller blind web is in particular joined to the second pull-out tube, such that its position is determined by way of the unwinding length of the roller blind web.

Preferably, the first pull-out tube is the pull-out tube that immediately adjoins the bearing tube, whereas the second pull-out tube immediately adjoins the first pull-out tube. However, it is also conceivable that further pull-out tubes are arranged between the first pull-out tube and the bearing tube, each of which further pull-out tubes is provided with a separate drive unit, such as a spring, or that further pull-out tubes abut on the second pull-out tube, said further pull-out tubes likewise being displaceable with the aid of a rope-operated arrangement where appropriate. The second pull-out tube is always borne in the first pull-out tube.

SUMMARY

In a preferred embodiment of the shading device according to the invention, the drive unit comprises or is a spring unit which takes effect in the pull-out direction, and which directly takes effect on the respective first pull-out tube, pretensioning the same in the direction of its pull-out position, wherein the winding unit is provided with a self-locking actuating unit, whose holding force is greater than the effective spring force of the spring unit. In this embodiment, the roller blind web is thus always pretensioned in the direction of its unwound position. The length of the section of the roller blind web having been unwound from the winding unit is predetermined by an actuation of the self-locking actuating unit. When the actuating unit is not actuated, a holding force takes effect, which prevents the roller blind web from unwinding further from the winding unit on grounds of the spring force of the spring units. When the roller blind web is being wound up onto the winding unit, the actuating unit takes effect against the spring force of the spring units taking effect in the pull-out direction. When the roller blind web is being unwound, the spring force supports the actuating unit. The spring-loaded telescopic tube arrangements, which automatically follow the unwinding length of the roller blind web, always hold the unwound region of the roller blind web under tension in the longitudinal direction of unwinding direction.

In order not to subject the spring force of the spring units to significant changes, independently of the position of the pull-out tubes vis-à-vis the bearing tube, the spring unit, in a special embodiment of the shading device according to the invention, comprises or is a gas pressure spring.

In an alternative embodiment of the shading device according to the invention, the drive unit for the respective telescopic tube arrangement comprises an electric motor. For example, the electric motor drives a drive cable which is rigid in compression, and which displaces the first pull-out tube vis-à-vis the bearing tube, or also a threaded spindle, which engages with a screw thread of the first pull-out tube.

In order to realize the positive control of the respective second pull-out tube when the first pull-out tube is being displaced, the rope arrangement, in a special embodiment of the shading device according to the invention, includes a rope, which is fastened to the bearing tube and to the second pull-out tube and is guided via at least one deflection unit, which is arranged at the first pull-out tube. Said rope may be a wire rope or also a plastic rope. In the context of a simple deflection at the first pull-out tube, the advancing path of the second pull-out tube vis-à-vis the first pull-out tube corresponds to the advancing path of the first pull-out tube vis-à-vis the bearing tube.

A deflection of the rope with particularly little friction is achieved when the deflection unit is a pulley. The pulley may directly be borne at the first pull-out tube. When resorting to a gas pressure spring as the drive unit for the telescopic arrangements, the deflection unit may also be arranged at the face side of a dip tube of the gas pressure spring, which tube is fixedly connected to the first pull-out tube.

In order to give high ease of use to the shading device according to the invention, the actuating unit of the winding unit is a drive motor in a preferred embodiment.

The drive motor may be an electric motor, which drives the winding unit via a gearing, which may be provided with a worm wheel and/or also with belt wheels. Such an arrangement is in particular suitable for a configuration in which the roller blind web is wound up onto a curved winding tube of the winding unit, said tube in particular being adapted to a boat design. It is conceivable to drive the winding unit on both sides with the help of a corresponding electric motor. With a worm wheel gearing, which is configured so as to be self-locking by way of a correspondingly small angle of inclination of the worm, a high moment of torsion can be introduced into the winding unit. In addition, the winding speed can be monitored easily and hence the unwinding length of the roller blind web can precisely be set in each intermediate position.

Alternatively, the drive motor may also be a so-called tubular motor, which is inserted into a winding tube of the winding unit. Said embodiment is particularly convenient in terms of installation space since no separate installation space has to be held available for the drive motor.

In order to guarantee a synchronous dislocation of the pull-out tubes being arranged on both sides, vis-à-vis the bearing tubes, the roller blind web, in a preferred embodiment, with its edge facing away from the winding unit, is joined to a transverse strut, which connects the second pull-out tubes of the two telescopic tube arrangements to one another. Hence, the risk of a so-called drawer effect when actuating the shading device is minimized.

In order to also realize a synchronism of the first pull-out tubes being arranged on both sides, a second transverse strut may be envisaged, which connects the two first pull-out tubes of the telescopic tube arrangements to each other and over which the roller blind web reaches, whereby sagging of the pulled-out section of the roller blind web is also countered.

According to a second aspect, the object is attained by a shading device of a vehicle, in particular of a water vehicle, comprising a roller blind web, a winding unit, onto which the roller blind web can be wound up or from which the roller blind web can be unwound and which, in relation to a longitudinal center plane of the roller blind web, is borne so as to be rotatable on both sides, and comprising, in relation to the longitudinal center plane of the roller blind web on each of its two sides, a telescopic tube arrangement having a bearing tube that is fixed relative to the vehicle and having at least one pull-out tube, which is displaceable between a slid-in position, the roller blind web having been wound up onto the winding unit when being in said position, and a pulled-out position, the roller blind web having been unwound from the winding unit when being in said position, wherein the winding unit, as its drive, includes at least one electric motor and the telescopic tube arrangements are pretensioned in the direction of their pull-out position with the aid of a spring unit.

According to a special embodiment, the electric motor drives the winding unit via a worm gearing.

Between the worm gearing and the winding unit, a drive belt, in particular a toothed drive belt, can be arranged, engaging with a drive wheel, which is connected to the winding unit for co-rotation.

In order to drive the winding unit symmetrically with respect to the longitudinal center plane of the roller blind web, it is preferred that the winding unit, on each of its two sides, is driven by a respective electric motor.

In an embodiment, by which the needed installation space can be reduced, the electric motor can be a tubular motor, which engages a winding tube of the winding unit.

In order to adapt the design of the shading device to the design of the respective vehicle, the winding unit can comprise a curved flexible winding tube, which reaches around a curved bearing bow.

As described above in connection with the first aspect, each of the telescopic tube arrangements of the shading device of the second aspect can comprise at least one first pull-out tube and one second pull-out tube, wherein at least one of the telescopic tube arrangements is provided with a drive unit, which directly drives the first pull-out tube, and in that a rope arrangement converts a relative movement of the first pull-out tube vis-à-vis the bearing tube into a relative movement of the second pull-out tube vis-à-vis the first pull-out tube.

The rope arrangement preferably comprises a rope, which is fastened to the second pull-out tube and is guided via at least one deflection unit, which is arranged at the first pull-out tube.

The deflection unit can be a pulley.

In order to prevent undesired unwinding of the roller blind web, it is preferred that a holding force is applied onto the winding unit in the unactuated state, said holding force being greater than the effective spring force of the spring unit. For instance, the holding force can be applied by the worm gearing, if the angle of inclination of the worm is sufficiently small.

Further advantages and advantageous configurations of the subject-matter of the invention can be taken from the description, from the drawing and from the claims.

BRIEF DESCRIPTION OF THE DRAWINGS

Exemplary embodiments of a shading unit according to the invention are illustrated in a schematically simplified way in the drawing and will be explained in more detail in the following description. In the figures.

DETAILED DESCRIPTION

Figure 1:
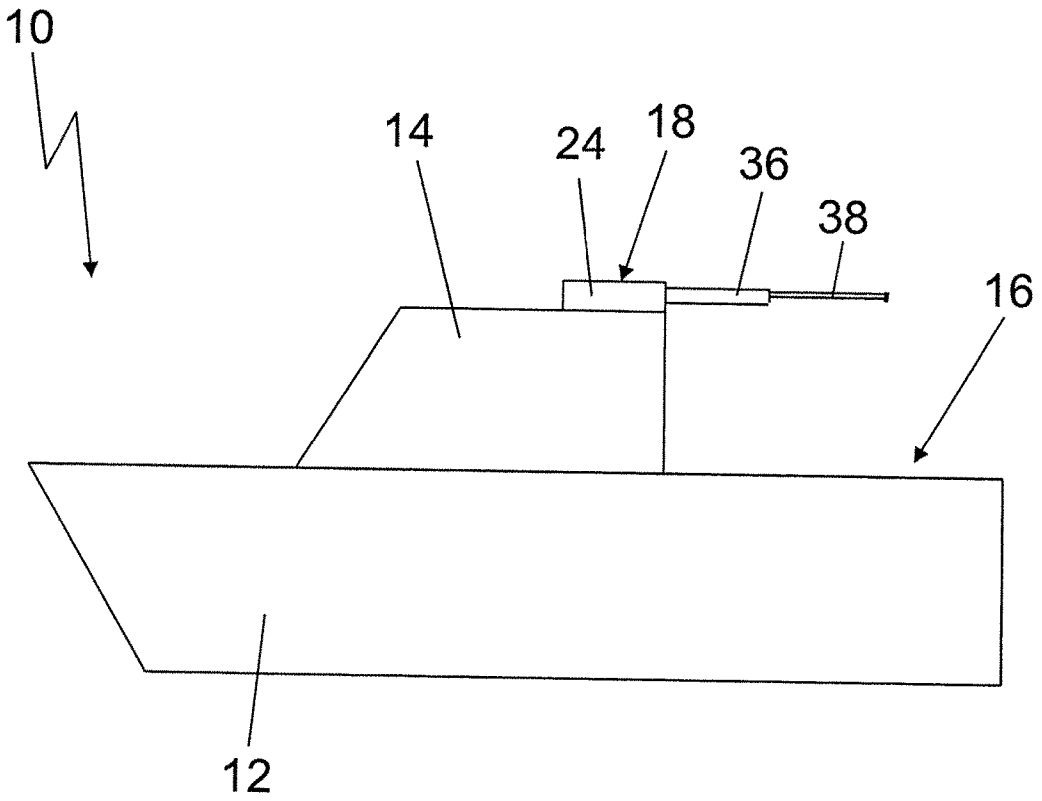
FIG. 1 shows a schematic side view of a motor yacht having a shading unit according to the invention.
Figure 2A:
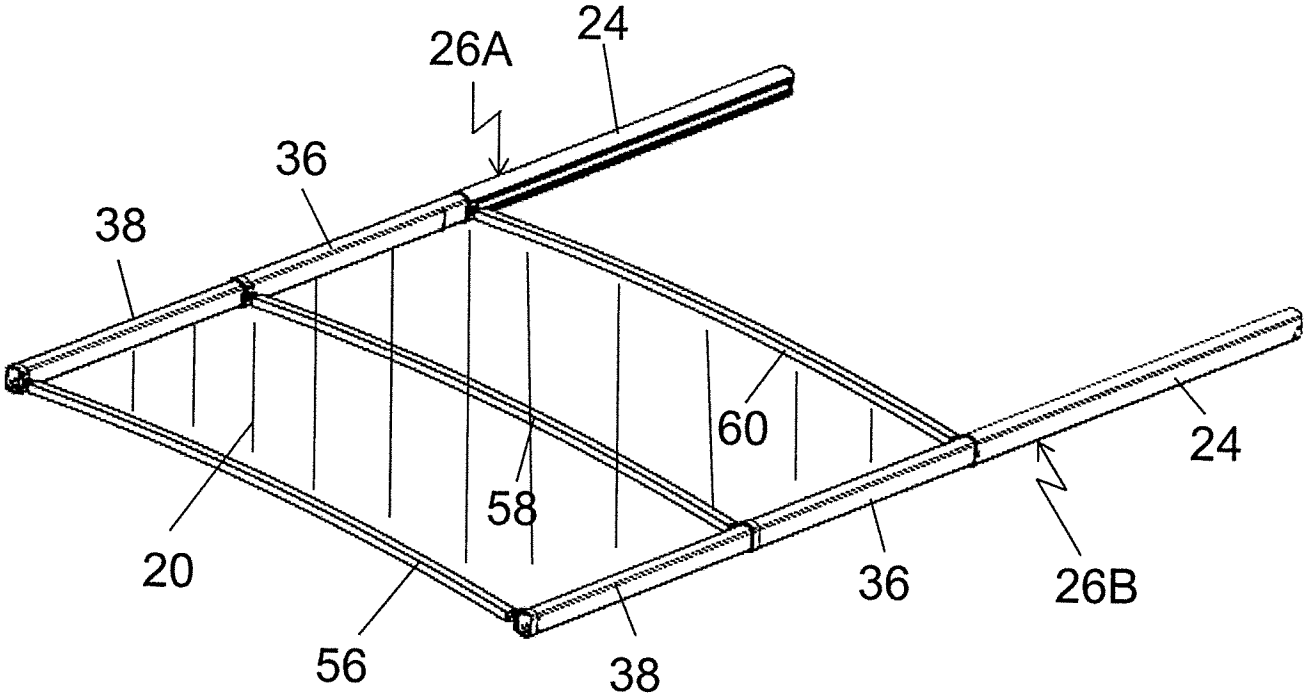
FIG. 2*a* shows a perspective view from above onto the shading unit on its own.
Figure 2C:
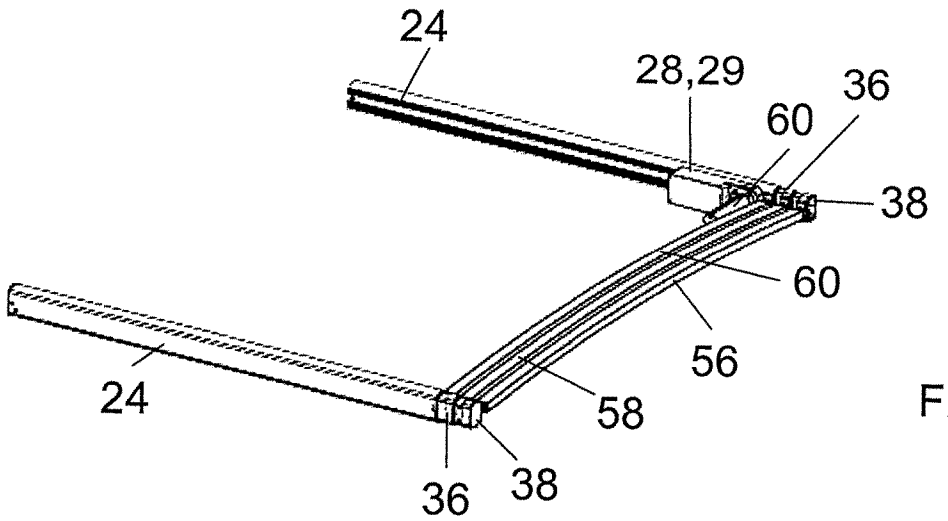
FIG. 2*c* shows a view corresponding to the view of FIG. 2*b*, wherein the shading unit is in slid-in position.
Figure 2B:
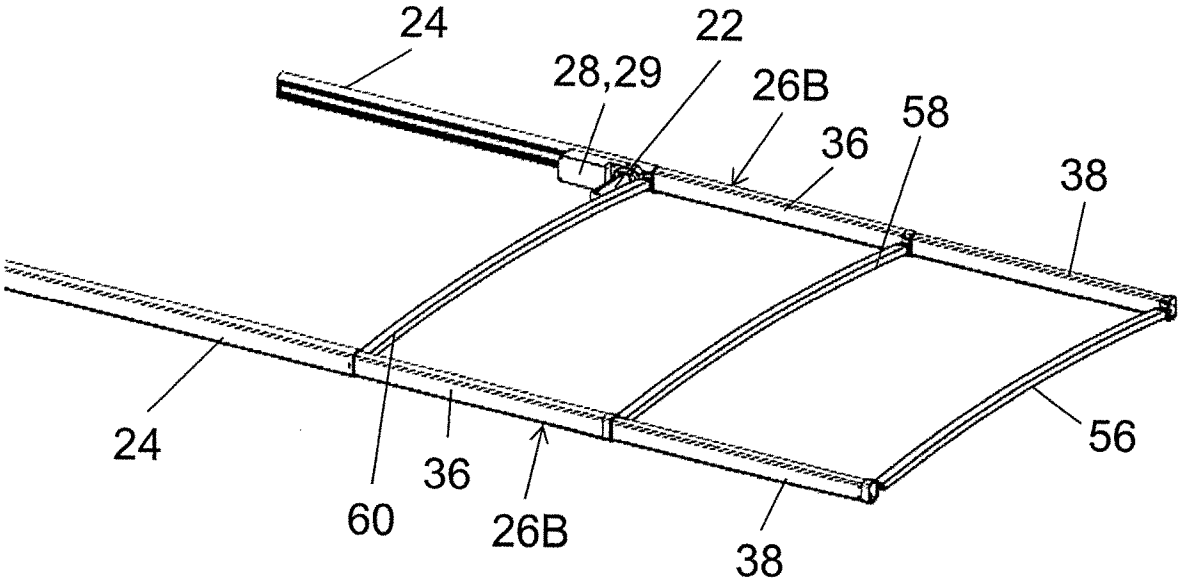
FIG. 2*b* shows a second perspective view from above onto the shading unit in pulled-out position.
Figure 3:
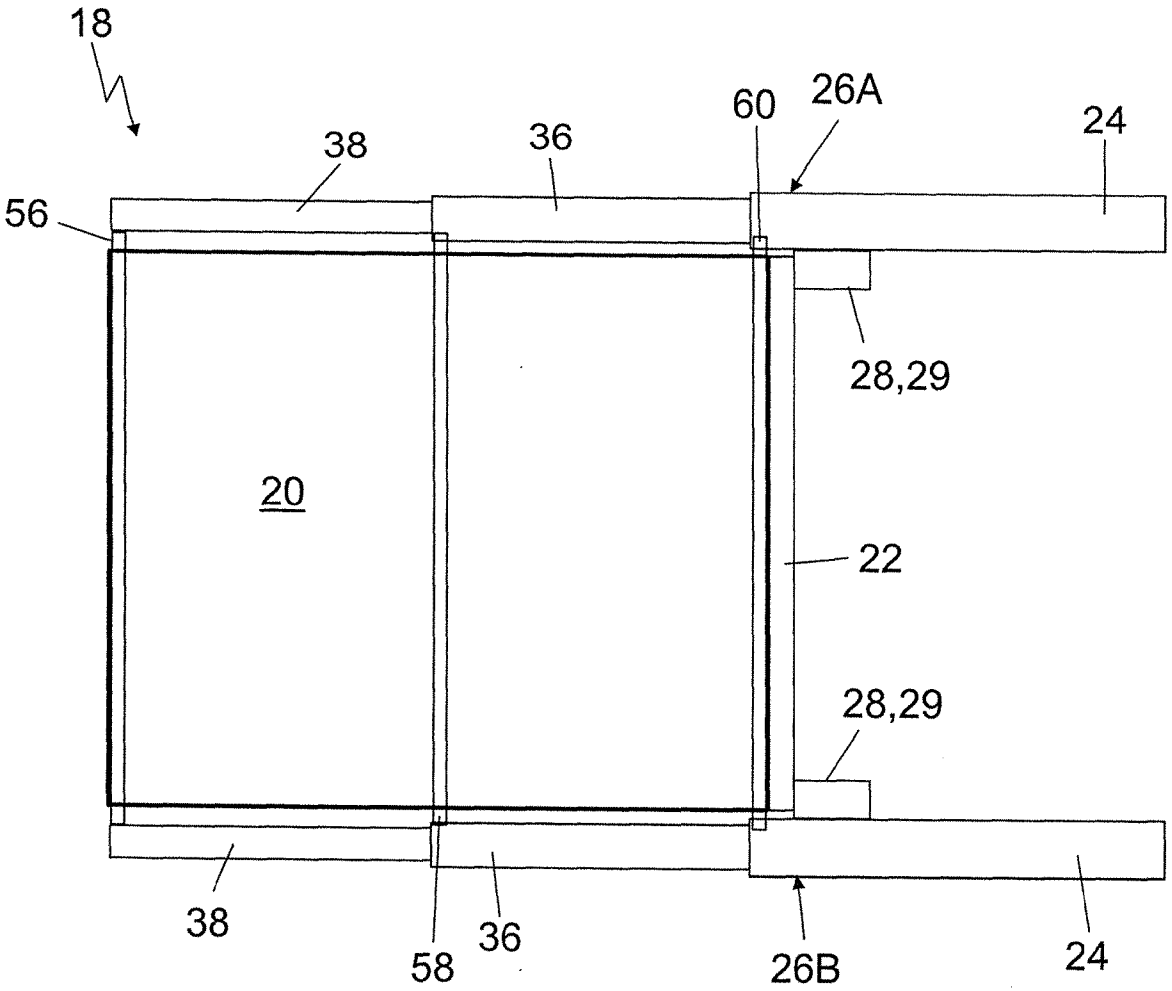
FIG. 3 shows a view from above onto the shading unit.
Figure 4:
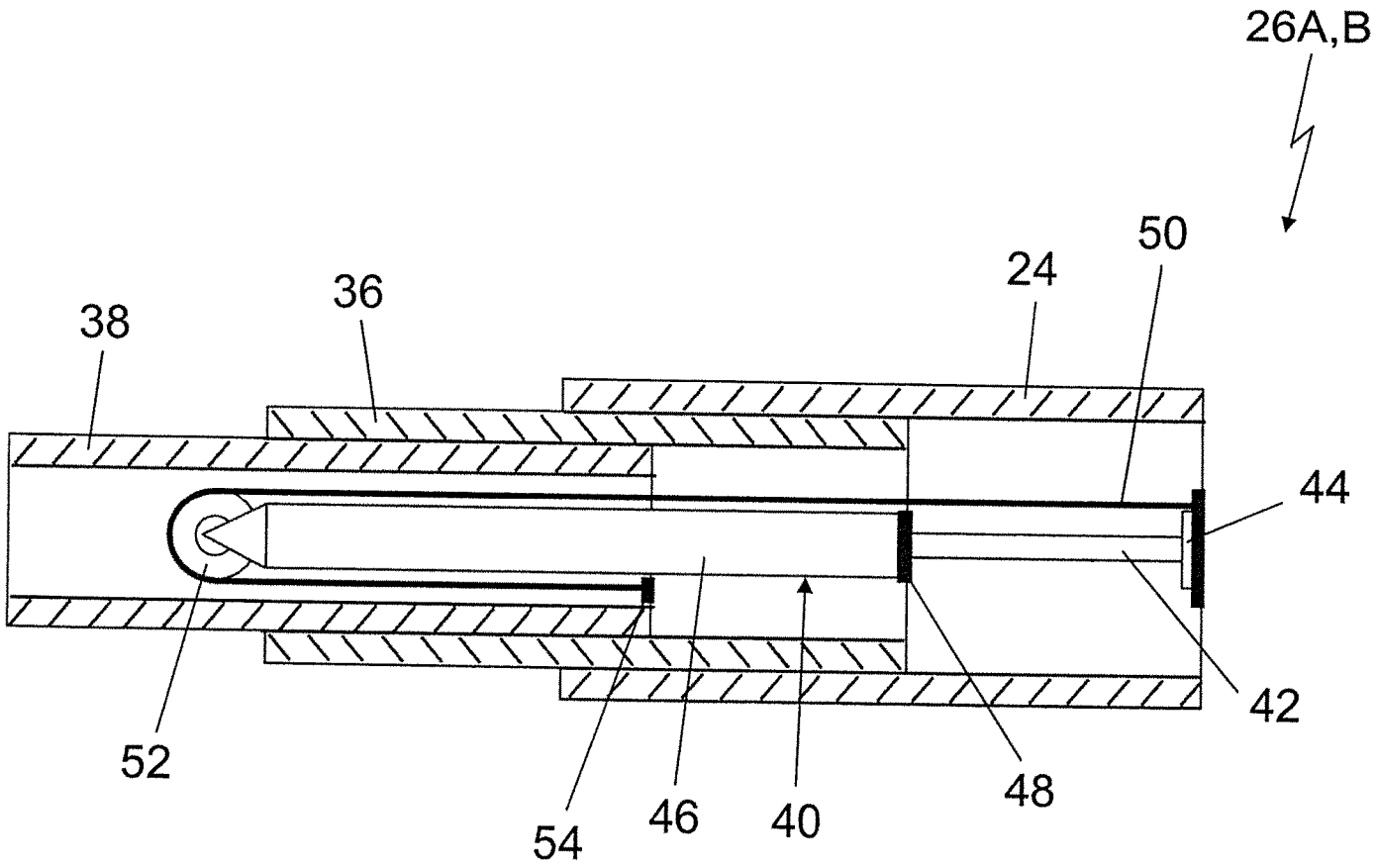
FIG. 4 shows a longitudinal section through a telescopic tube arrangement of the shading unit.
Figure 6:
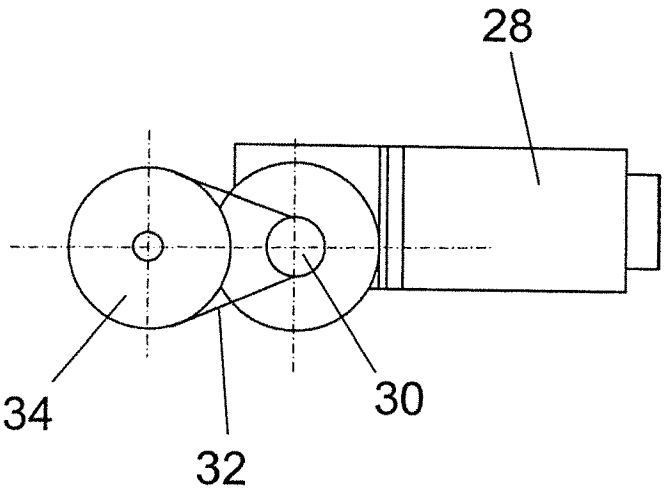
FIG. 6 shows a side view of the actuating unit.
Figure 5:
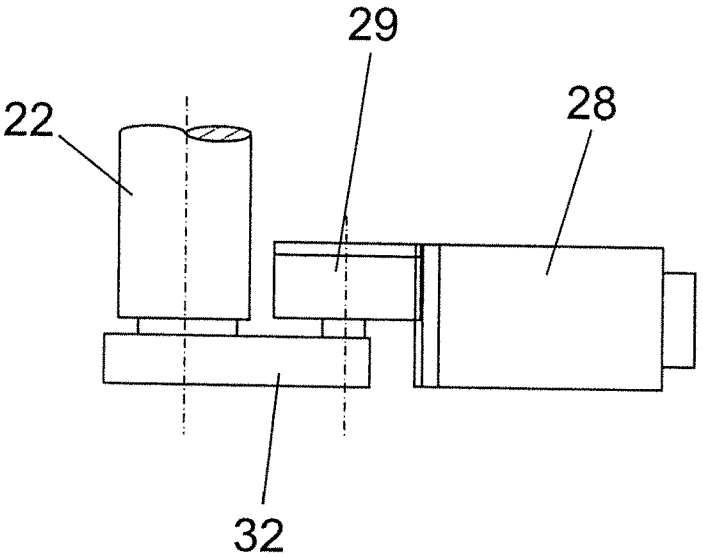
FIG. 5 shows a view from above onto an actuating unit for a winding unit of the shading device.
Figure 7:
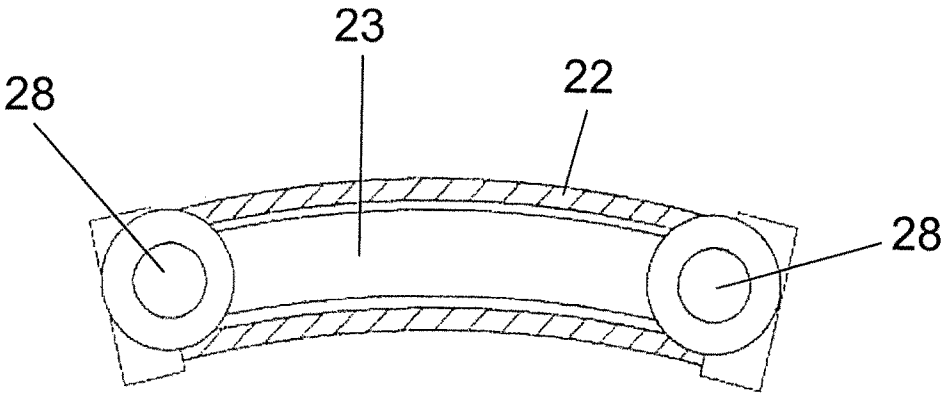
FIG. 7 shows a schematic sectional illustration of the winding unit.

In FIG. 1, a boat 10 is illustrated which is realized as a motor yacht, and which includes a hull 12 and a yacht superstructure 14 being arranged on the hull 12. In the rear of the yacht superstructure 14, a deck 16 is realized, which, at the very least in sections, can be shaded with the aid of a shading device 18, which is fastened on a roof of the yacht superstructure 14 and which will be explained in more detail in the following, using FIGS. 2 to 7.

The shading device 18 comprises a roller blind web 20 forming a shading element and being made from an non-transparent foldable textile material, said roller blind web being fastened, with a bow-side edge in relation to the orientation of the hull 12, to a winding tube 22 constituting a winding unit, onto which tube it can be wound up for uncovering the deck 16 or from which it can be unwound for shading the deck 16.

The winding tube 22, in relation to a vertical longitudinal center plane of the roller blind, is borne at a bearing tube 24 of a respective telescopic tube arrangement 26A or 26B so as to be rotatable on both sides. The two telescopic arrangements 26A and 26B are fastened on the yacht superstructure 14 via the bearing tubes 24.

In order to actuate or to rotate the winding tube 22, which, in the present case, is realized so as to be curved and flexible and surrounds a bearing bow 23, the shading device 18, as an actuating unit, includes a drive motor 28 at each of the two bearing tubes 24, said motor being realized as an electric motor. Via one worm wheel 29 in each instance, the drive motors 28 drive a driving toothed wheel 30, which drives the winding tube 22 (cf. FIGS. 5 to 7) via a toothed drive belt 32, which engages with a toothed wheel 34 being connected to the winding tube 22 for co-rotation. The drive motors 28, which thus take effect on the winding tube 22 via a gearing in each instance and which are electronically synchronized, are reversible; that means that the winding tube 22 can be driven with the aid of the drive motors 28 in both rotation directions. The drive motors 28, the gearings and the winding tube 22 can be fastened to the bearing tubes 24 via common bearing plates.

Each of the two telescopic tube arrangements 26A and 26B comprises a first pull-out tube 36, which is slidably borne in the bearing tube 24, and a second pull-out tube 38, which is slidably borne in the first pull-out tube 36. Hence, each of the telescopic tube arrangements 26A and 26B is displaceable between a slid-in position, in which the pull-out tubes 36 and 38 are accommodated by the bearing tube 24, and a pulled-out position, the pull-out tubes 36 and 38 having been pulled out of the bearing tube 24 when being in said position.

In order to bring the telescopic tube arrangements 26A and 26B from the slid-in position into the pulled-out position, each of the telescopic tube arrangements 26A and 26B includes a gas pressure spring 40, whose piston 42 is fixed to the respective bearing tube 24 via a piston foot 44. The piston 42 is guided in a dip tube 46, which, with a dip tube foot 48, is fixed to the face-side end of the first pull-out tube 36 facing the piston foot 44. The dip tube 46 of the gas pressure spring 40 reaches through the first pull-out tube 36 and engages the second pull-out tube 38. With the aid of the gas pressure spring 40, the first pull-out tube 36 is pretensioned in the pull-out direction.

In order to convert a relative movement of the first pull-out tube 36 vis-à-vis the bearing tube 24 into a relative movement of the second pull-out tube 38 vis-à-vis the first pull-out tube 36, each of the two telescopic tube arrangements 26A or 26B includes a rope 50 which forms a rope arrangement, and which is realized as a wire rope and is fastened, with one end, in the region of the piston foot 44, to the bearing tube 24, is guided via a deflection unit 52 being realized as a pulley, which is borne so as to be rotatable at a face side of the dip tube 46 facing away from the dip tube foot 48, and is fastened, with its second end 54, to the second pull-out tube 38 after deflection, namely to the face-side end of the second pull-out tube 38 facing the piston foot 44. Hence, the two pull-out tubes 36 and 38 have a dependent pull-out or slide-in behavior. If, for example, a pressure is exerted onto the pull-out tube 38 in the direction of the bearing tube 24, the first pull-out tube 36 is shifted vis-à-vis the bearing tube 24 by the same amount as the second pull-out tube 38 vis-à-vis the first pull-out tube 36.

In order to synchronize the movement behavior of the telescopic tube arrangements 26A and 26B being arranged on both sides, the second pull-out tubes 38 being arranged on both sides are connected to each other via a transverse strut 56, which forms the face-side end of the shading device 18 and to which the edge of the roller blind web 20 facing away from the winding tube 22 is fastened. In addition, the two first pull-out tubes 36, in their face-side end regions, are connected via a further transverse strut 58, over which the roller blind web 20 reaches. Moreover, the bearing tubes 24 are connected to each other via a transverse strut 60, which forms a trailing edge for the roller blind web 20 and increases the inherent rigidity of the shading device 18.

Figure 8A:
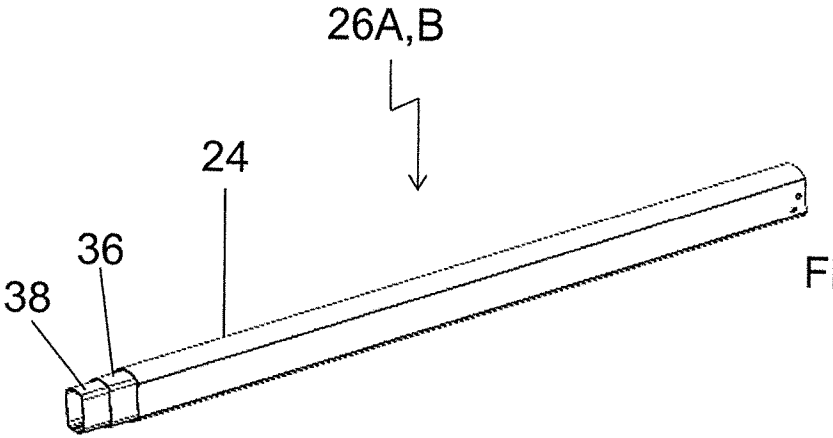
FIG. 8*a* shows a perspective view of a special embodiment of telescopic tube arrangement
Figure 8B:
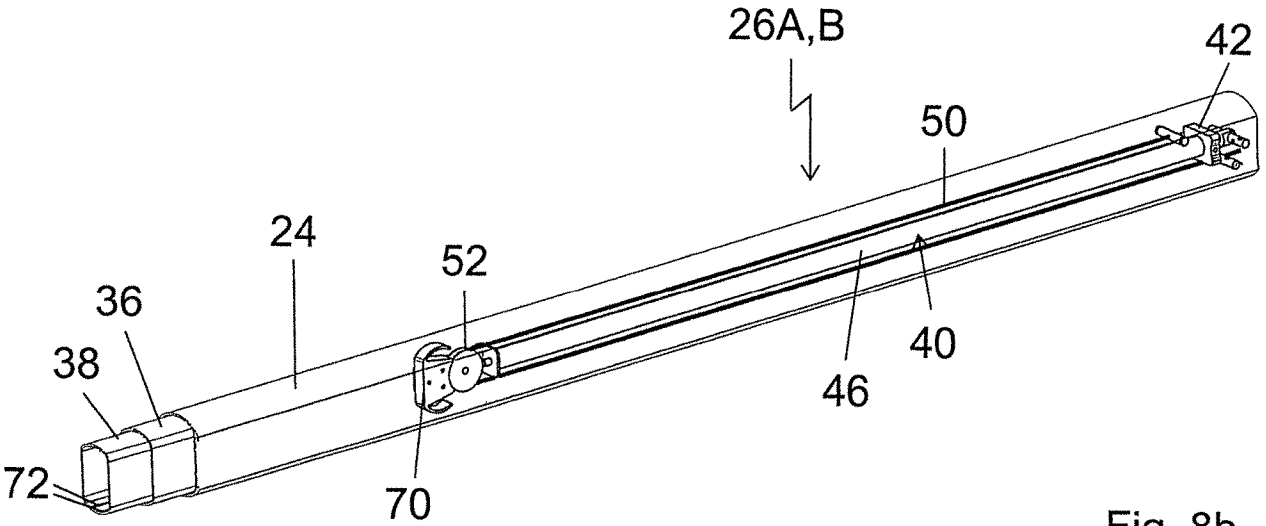
FIG. 8*b* shows the telescopic tube arrangement of FIG. 8*a* in a transparent illustration.
Figure 8C:
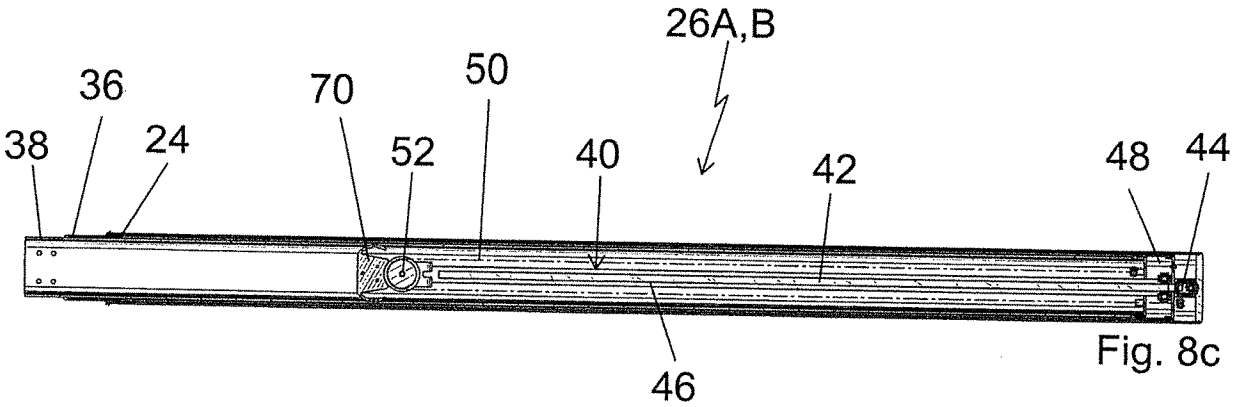
FIG. 8*c* shows a longitudinal sectional view of the telescopic tube arrangement according to FIG. 8*a;*
Figure 9:
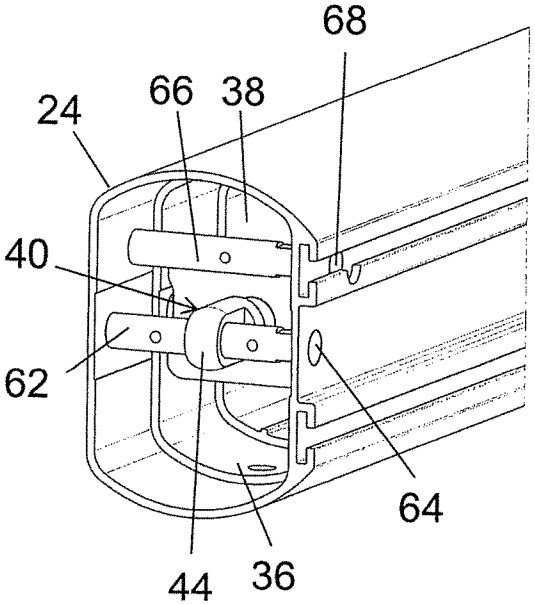
FIG. 9 shows a rear end section of the telescopic tube arrangement according to FIG. 8*a;*

In FIGS. 8 and 9, a special embodiment of a telescopic tube arrangement 26A or 26B for a shading device of the kind being illustrated in FIGS. 1 to 7 is shown. The telescopic tube arrangement 26A or 26B is largely realized so as to correspond to the above-described embodiment and comprises the bearing tube 24, the first pull-out tube 36 being guided in the bearing tube 24 and the second pull-out tube 38 being guided in the first pull-out tube 36. In the telescopic tube arrangement 26A or 26B, a gas pressure spring 40 is arranged which is provided with a piston 42 and a dip tube 46, and which is fastened, with its piston foot 44 to a bearing pin 62. The bearing pin 62 has tapered end regions, each of which is borne in a hole, in particular in a keyhole 64, wherein the tapered region of the keyholes 64 faces away from the dip tube 46 of the gas pressure spring 40, such that the bearing pin 62 is held in position by way of the pressure being exerted by the gas pressure spring 40.

The rope 50 which forms a rope arrangement, and with the aid of which a movement of the first pull-out tube 36 is converted into a movement of the second pull-out tube 38 vis-à-vis the first pull-out tube 36, is likewise fixed to a bearing pin 66, which is configured so as to be identical to bearing pin 62, but is held, with its end sections having a smaller diameter, in holes, in particular in keyholes 68, whose respective tapered region faces the dip tube 46 of the gas pressure spring 40. The tensile force being exerted by the rope 50 onto the bearing pin 66 holds the same in position. The rope 50 is deflected at the deflection unit 52 being realized as a pulley and is fastened to the second pull-out tube 38 with its second end.

For guiding the gas pressure spring 40 in the second pull-out tube 38, a slide 70 is fastened to the front face side of the dip tube 46 of the gas pressure spring 40, said slide being guided at guide ribs 72, which are realized at the inner side of the second pull-out tube 38 and extend in the longitudinal direction thereof.

Figure 10:
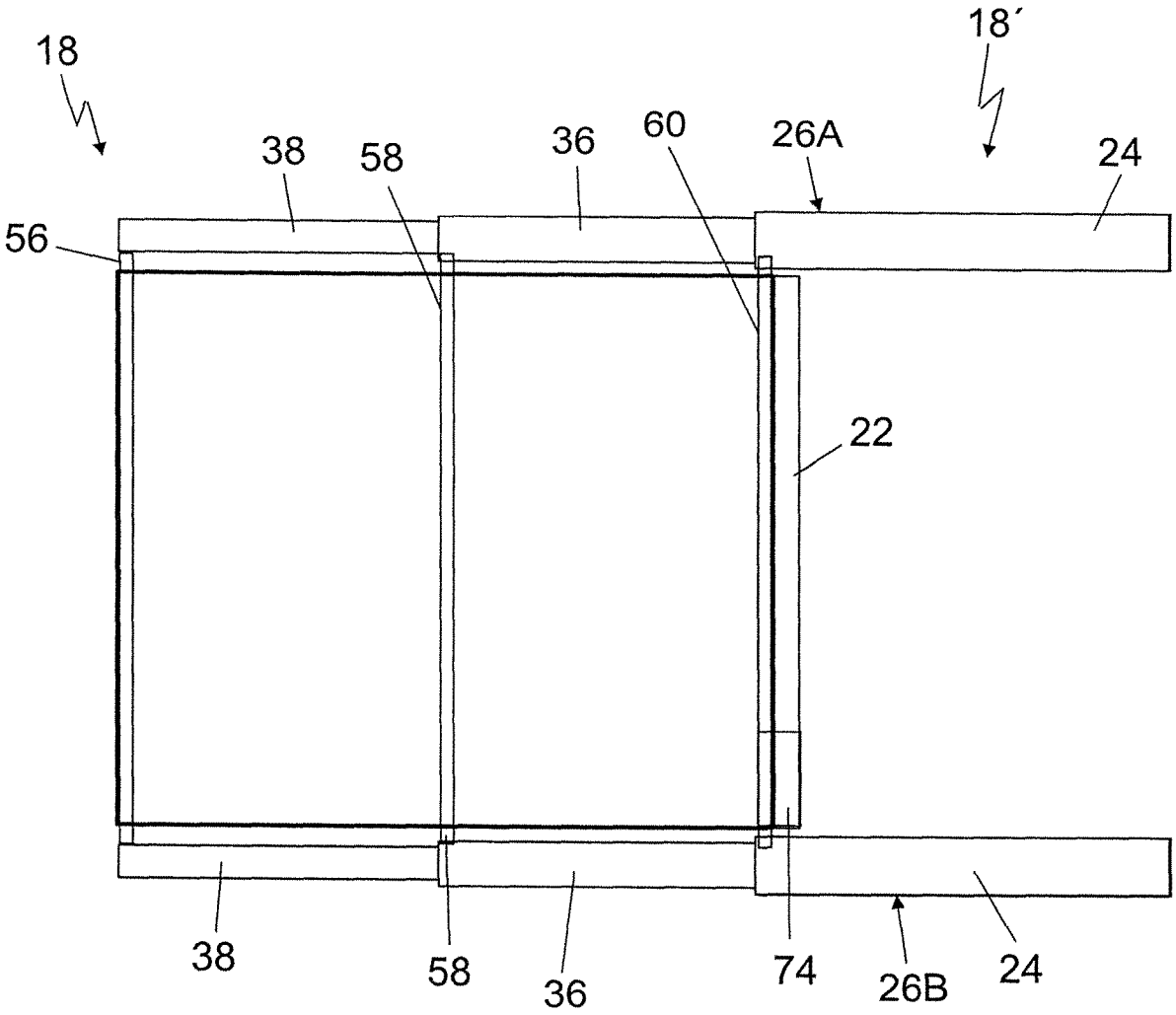
FIG. 10 shows a schematic view from above onto an alternative embodiment of a shading device according to the invention.

In FIG. 10, an alternative embodiment of a shading device 18' is illustrated, which substantially corresponds to the shading device according to FIGS. 1 to 7, but differs from the same in that the winding tube 22 is driven with the aid of a tubular motor 74, which engages the winding tube 22. Apart from that, shading device 18' corresponds to the shading device being illustrated in FIGS. 1 to 7.

Figure 11:
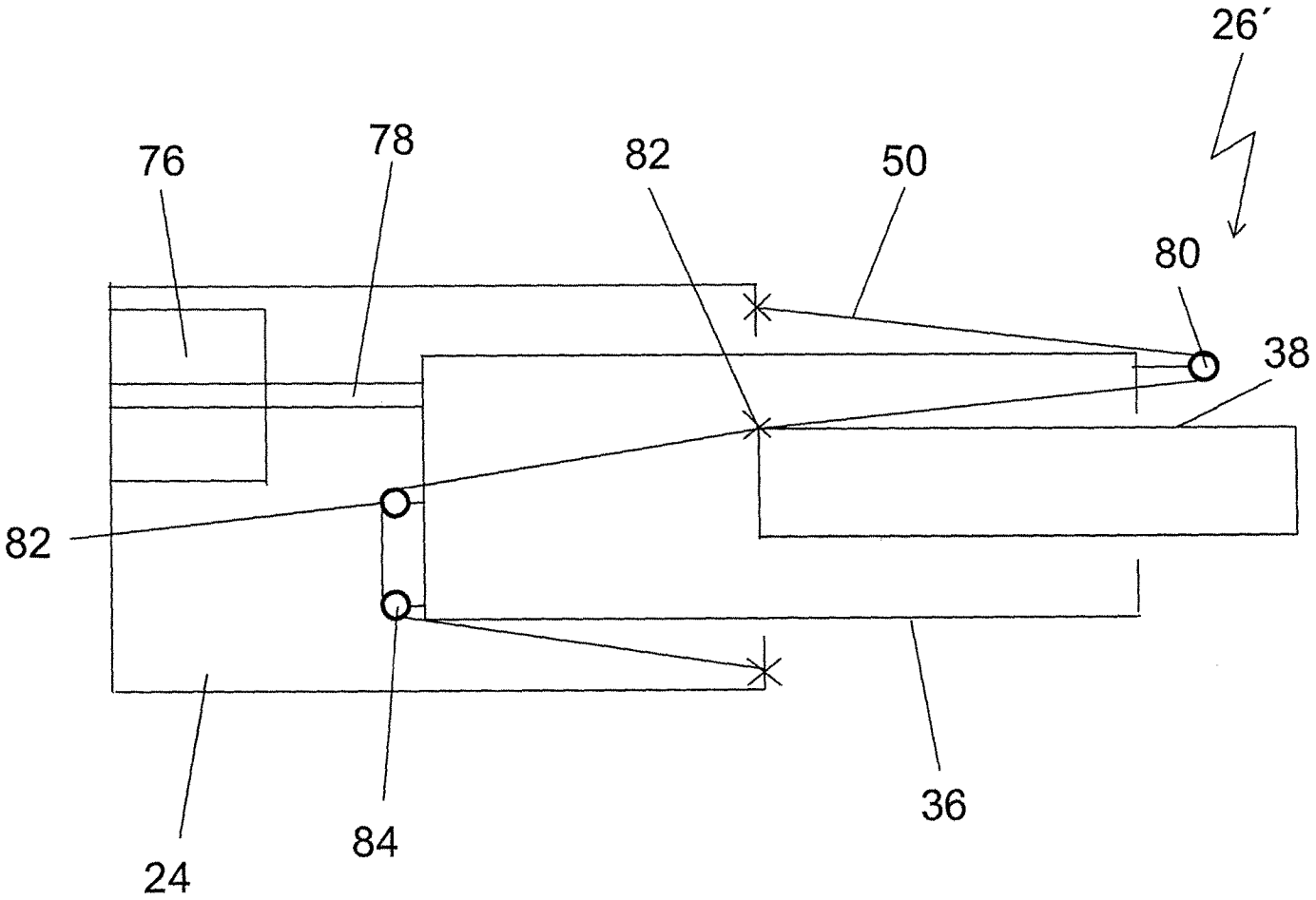
FIG. 11 shows a longitudinal section through an alternative embodiment of a telescopic tube arrangement of a shading device according to the invention.

In FIG. 11, a special embodiment of a telescopic tube arrangement 26' is illustrated, which is part of a shading device of the above-described kind and includes a bearing tube 24, which can be fastened to a boat superstructure. In the bearing tube 24, a first pull-out tube 36 is shiftably guided, a second pull-out tube 38 in turn being shiftably guided in said first pull-out tube. In order to shift the first pull-out tube 36 vis-à-vis the bearing tube 24, an electric motor 76 is envisaged, which drives a drive cable 78 which is rigid in compression, and which is joined to the first pull-out tube 36. In order to be able to convert the relative movement of the first pull-out tube 36 vis-à-vis the bearing tube 24 into a relative movement of the second pull-out tube 38 vis-à-vis the first pull-out tube 36, the telescopic tube arrangement 26' includes a rope 50, which, with its two ends, is fastened to the bearing tube 24. In addition, the rope 50 is deflected at a first deflection pulley 80 being arranged at a front face side of the first pull-out tube 36, is fastened to a fastening point 82 at the second pull-out tube 38 and is deflected at two further deflection pulleys 84 and 86, which are arranged at the face side of the first pull-out tube 36 facing away from deflection pulley 80. Hence, pull-out tube 38 is dislocated vis-à-vis pull-out tube 36 when pull-out tube 36 is advanced vis-à-vis the bearing tube 24. A winding unit of the respective shading device can comprise a winding tube which is pretensioned in winding-up direction, so that the respective roller blind web is automatically wound-up when the pull-out tubes 36 and 38 are moved into the bearing tube by operating the electric motor 76.

LIST OF REFERENCE NUMERALS

10 boat
12 hull
14 yacht superstructure
16 deck
18, 18' shading device
20 roller blind web
22 winding tube
23 bearing bow
24 bearing tube
26A, B, 26' telescopic tube arrangement
28 drive motor
29 worm wheel
30 driving toothed wheel
32 toothed drive belt
34 toothed wheel
36 pull-out tube
38 pull-out tube
40 gas pressure spring
42 piston
44 piston foot
46 dip tube
48 dip tube foot
50 rope
52 deflection unit
54 end
56 transverse strut
58 transverse strut
60 transverse strut
62 bearing pin
64 keyhole
66 bearing pin
68 keyhole
70 slide
72 guide ribs
74 tubular motor
76 electric motor
78 drive cable
80 deflection pulley
82 fastening point
84 deflection pulley
86 deflection pulley

The invention claimed is:

1. A shading device of a vehicle, comprising a roller blind web, a winding unit, onto which the roller blind web can be wound up or from which the roller blind web can be unwound and which, in relation to a longitudinal center plane of the roller blind web, is borne on both sides so as to be rotatable, and comprising, in relation to the longitudinal center plane of the roller blind web on each of its two sides, a telescopic tube arrangement having a bearing tube that is fixed relative to the vehicle and having at least one first pull-out tube and one second pull-out tube, which are displaceable between a slid-in position, the roller blind web having been wound up onto the winding unit when being in said position, and a pulled-out position, the roller blind web having been unwound from the winding unit when being in said position, wherein at least one of the telescopic tube arrangements is provided with a drive unit, which directly drives the first pull-out tube, a rope arrangement converting a relative movement of the first pull-out tube vis-a-vis the bearing tube into a relative movement of the second pull-out tube vis-a-vis the first pull-out tube.

2. The shading device according to claim 1, wherein the drive unit comprises a spring unit which takes effect in the pull-out direction, and which pretensions the respective first pull-out tube in the pull-out direction, and in that the winding unit is provided with a self-locking actuating unit, whose holding force is greater in the unactuated state than the effective spring force of the spring unit.

3. The shading device according to claim 2, wherein the spring unit comprises a gas pressure spring.

4. The shading device according to claim 1, wherein the drive unit comprises an electric motor.

5. The shading device according to claim 4, wherein the electric motor drives a threaded spindle, which engages with a screw thread, which is arranged at the respective first pull-out tube, or in that the motor drives a drive cable which is rigid in compression, and which is fastened to the first pull-out tube.

6. The shading device according to claim 1, wherein the rope arrangement comprises a rope, which is fastened to the second pull-out tube and is guided via at least one deflection unit, which is arranged at the first pull-out tube.

7. The shading device according to claim 6, wherein the deflection unit is a pulley.

8. The shading device according to claim 1, wherein the winding unit is provided with a drive motor.

9. The shading device according to claim 8, wherein the drive motor drives the winding unit via a gearing.

10. The shading device according to claim 8, wherein the winding unit comprises a winding tube and in that the drive motor is a tubular motor, which engages the winding tube.

11. The shading device according to claim 1, wherein the roller blind web, with its edge facing away from the winding unit, is joined to a transverse strut, which connects the second pull-out tubes of the two telescopic tube arrangements to one another.

12. The shading device according to claim 1, wherein the two first pull-out tubes of the telescopic tube arrangements are connected to each other via a transverse strut, the roller blind web reaching over said strut.

13. A shading device of a vehicle, comprising a roller blind web, a winding unit, onto which the roller blind web can be wound up or from which the roller blind web can be unwound and which, in relation to a longitudinal center plane of the roller blind web, is borne so as to be rotatable on both sides, and comprising, in relation to the longitudinal center plane of the roller blind web on each of its two sides, a telescopic tube arrangement having a bearing tube that is fixed relative to the vehicle and having at least one pull-out tube, which is displaceable between a slid-in position, the roller blind web having been wound up onto the winding unit when being in said position, and a pulled-out position, the roller blind web having been unwound from the winding unit when being in said position, wherein the winding unit, as its drive, includes at least one electric motor and the telescopic tube arrangements are pretensioned in the direction of their pull-out position with the aid of a spring unit.

14. The shading device according to claim 13, wherein the electric motor drives the winding unit via a worm gearing.

15. The shading device according to claim 14, wherein between the worm gearing and the winding unit, a drive belt is arranged, engaging with a drive wheel, which is connected to the winding unit for co-rotation.

16. The shading device according to claim 13, wherein the winding unit, on each of its two sides, is driven by an electric motor.

17. The shading device according to claim 13, wherein the electric motor is a tubular motor, which engages a winding tube of the winding unit.

18. The shading device according to claim 13, wherein the winding unit comprises a curved flexible winding tube, which reaches around a curved bearing bow.

19. The shading device according to claim 13, wherein each of the telescopic tube arrangements comprises at least one first pull-out tube and one second pull-out tube and wherein at least one of the telescopic tube arrangements is provided with a drive unit, which directly drives the first pull-out tube, and in that a rope arrangement converts a relative movement of the first pull-out tube vis-a-vis the bearing tube into a relative movement of the second pull-out tube vis-a-vis the first pull-out tube.

20. The shading device according to claim 19, wherein the rope arrangement comprises a rope, which is fastened to the second pull-out tube and is guided via at least one deflection unit, which is arranged at the first pull-out tube.

21. The shading device according to claim 20, wherein the deflection unit is a pulley.

22. The shading device according to claim 13, wherein a holding force is applied onto the winding unit in the unactuated state, the holding force being greater than the effective spring force of the spring unit.

* * * * *